US005150005A

United States Patent [19]

Yokono

[11] Patent Number: 5,150,005

[45] Date of Patent: Sep. 22, 1992

[54] VACUUM FLUORESCENT DISPLAY PANEL HAVING AN ALKALI-FREE GLASS PLATE

[75] Inventor: Shinji Yokono, Tokyo, Japan

[73] Assignee: NEC Corporation, Tokyo, Japan

[21] Appl. No.: 596,545

[22] Filed: Oct. 11, 1990

[30] Foreign Application Priority Data

Oct. 12, 1989 [JP] Japan ..... 1-266944

[51] Int. Cl.[5] ..... H01J 31/15; H01J 63/02

[52] U.S. Cl. ..... 313/495; 313/493; 313/497

[58] Field of Search ..... 313/495, 497, 496, 493

[56] References Cited

U.S. PATENT DOCUMENTS

| | | | |
|---|---|---|---|
| 4,100,965 | 7/1978 | Kobayakawa et al. | 313/497 |
| 4,112,329 | 9/1978 | Veith | 313/493 |
| 4,164,683 | 8/1979 | Nakamura et al. | 313/496 |
| 4,613,399 | 9/1986 | Kobale et al. | 313/495 |
| 4,841,194 | 6/1989 | Kishino et al. | 313/496 |

FOREIGN PATENT DOCUMENTS

| | | | |
|---|---|---|---|
| 0096449 | 6/1982 | Japan | 313/495 |

OTHER PUBLICATIONS

"Improvement of Electrical Performance of CdSe TFTs for Application to VFDs" T. Shimojo, S. Okada, H. Kamogawa, and M. Kobayashi; Proceedings of the SID, vol. 29/1, 1988.

*Primary Examiner*—Donald J. Yusko
*Assistant Examiner*—Brian Zimmerman

[57] ABSTRACT

In a thin film transistor controlled vacuum fluorescent display panel, alkali-free glass is used for an anode substrate. The alkali-free glass plate is provided with thin film transistors and anode-phosphor layers formed thereon. An intermediate glass plate is interposed between the alkali-free glass plate and a vacuum envelope. The value of the coefficient of linear expansion of the intermediate glass plate is selected to be between the value of the coefficient of linear expansion of glass constituting the vacuum envelope and the value of the coefficient of linear expansion of the alkali-free glass plate so as to control the influence of the distortion due to thermal stress of the panel to the anode substrate at the time of manufacture of the panel.

3 Claims, 1 Drawing Sheet

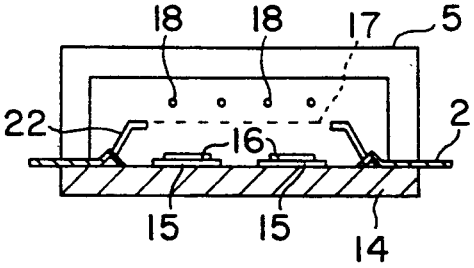
FIG. 1
(PRIOR ART)
FIG. 2
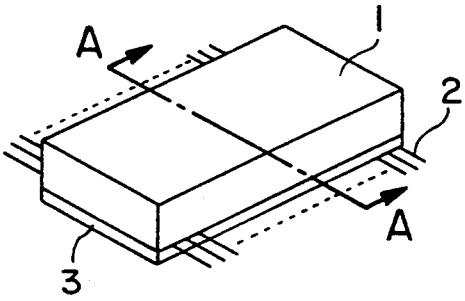
FIG. 4
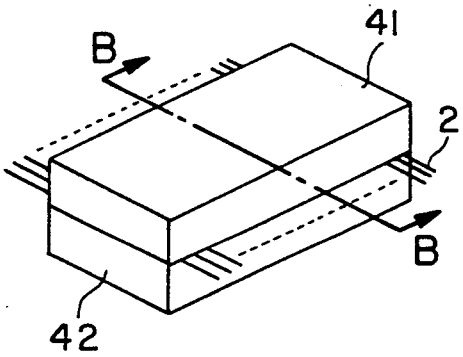
FIG. 3
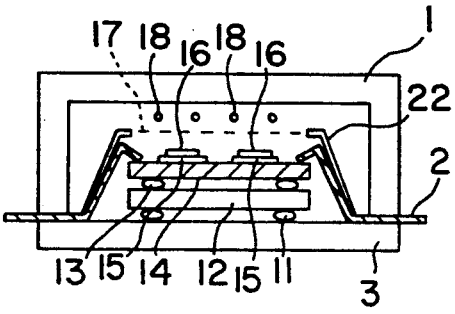
FIG. 5
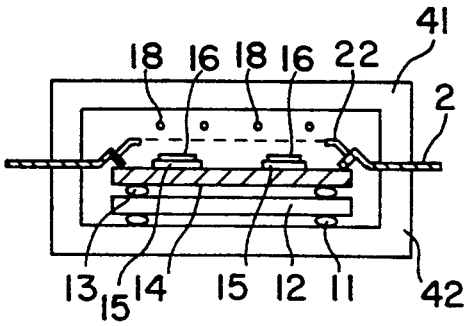

VACUUM FLUORESCENT DISPLAY PANEL HAVING AN ALKALI-FREE GLASS PLATE

BACKGROUND OF THE INVENTION

The present invention relates to a vacuum fluorescent display (VFD) panel, and more particularly to a thin film transistor (TFT) controlled VFD panel having an alkali-free glass plate therein.

The conventional TFT controlled VFD panel was reported by T. Shimojo et al. in Proceedings of the SID, vol. 29/1, pp. 65–69, 1988 under the title of "Improvement of Electrical Performance of CdSe TFTs for Application to VFDs". When TFTs as switching elements for each pixel are formed directly on an anode substrate, the anode substrate should be made of alkali-free glass. As shown in FIG. 1, a conventional TFT controlled VFD panel has TFTs 15 on an anode substrate 14 and anode-phosphor layers 16 are formed on the TFTs 15, and a grid electrode 17 and filament cathodes 18 are disposed thereabove. Leads 2 are sandwiched between the anode substrate 14 and a cover glass 5. The lead terminals 2 are connected to internal terminals (not shown). Reference numeral 22 shows a spacer member that supports and conducts current to the grid electrode 17. Moreover, the tip of the lead terminal 2 inside the cover is bent so as to be connected under compression to a wiring conductor terminal (not shown) formed on the anode substrate 14. These components have structures identical to those of the conventional VFD panel.

The TFT array on the anode substrate is mostly formed by using semiconductor materials. However, it is formed not on a soda-lime glass plate which contains and precipitates alkaline components that deteriorate the characteristics of the semiconductor materials, but on an alkali-free glass plate of quartz glass, boro-silicate glass or the like.

However, commercially available alkali-free glass plates are only those with thickness up to about 1 mm. When such a thin commercial alkali-free glass plate is used as the anode substrate and constitutes a portion of the vacuum envelope, a large size envelope cannot be achieved and thus the display area is compelled to be restricted.

In addition, if the cover glass were made of the alkali-free glass, the TFT controlled VFD panel of the conventional structure would have a problem that the fabrication cost is sharply raised and is not practical compared with the ordinary VFD panel whose enclosure consists entirely of soda-lime glass. Moreover, when a vacuum envelope is assembled by using a cover glass made of inexpensive soda-lime glass (with coefficient of linear expansion of $9.5\times10^{-6}/°$ C.) and an anode substrate made of alkali-free glass (quartz glass with coefficient of linear expansion of $0.5\times10^{-6}/°$ C.), there was a problem that the yield drops drastically due to generation of cracks and the like caused by the distortion due to the difference in the coefficients of linear expansion generated at the time of elevation or lowering of the temperature for sealing, exhaust or the like.

SUMMARY OF THE INVENTION

The TFT controlled VFD panel of the present invention uses an inexpensive glass for an envelope. An anode substrate made of alkali-free glass plate is installed within the envelope and is supported by an intermediate glass plate which has a coefficient of linear expansion between those of the anode substrate and the envelope.

BRIEF DESCRIPTION OF THE DRAWINGS

FIG. 1 is a schematic sectional view showing an example of the conventional TFT controlled VFD panel.

FIG. 2 is a schematic perspective view of the TFT controlled VFD panel in accordance with a first embodiment of the present invention.

FIG. 3 is a schematic sectional view taken along the line A—A in FIG. 2.

FIG. 4 is a schematic perspective view of the TFT controlled VFD panel in accordance with a second embodiment of the present invention.

FIG. 5 is a schematic sectional view taken along the line B—B in FIG. 4.

DESCRIPTION OF PREFERRED EMBODIMENTS

Referring to FIG. 2 and FIG. 3, an intermediate glass plate 12 is installed on a substrate glass 3 consisting of soda-lime glass by using a ceramic adhesive material 11 consisting mainly of alumina and inorganic polymers. Then, an anode substrate 14 consisting of alkali-free glass plate with TFTs 15 and anode-phosphor layers 16 formed thereon is installed on the intermediate glass plate 12 by using a ceramic adhesive material 13 consisting mostly of zirconia, silica and inorganic polymers. Next, grid electrodes 17 and a filament cathode 18 are installed above the anode-phosphor layers 16, a box-shaped cover glass 1 is installed on the substrate glass 3 with lead terminals 2 connected to the respective internal electrodes, seal the device with first glass that has been applied in advance to the junction and completing the fabrication by way of exhaust and the like; thereby obtaining a panel as shown in FIG. 2. In the figure, reference numeral 22 is a spacer for supporting and conducting current to the grid electrode 17, and the spacer for the filament cathode is omitted from the figure as in the figure for the prior art.

Referring to FIG. 4 and FIG. 5, the second embodiment of the present invention will be described. This embodiment has a construction in which a vacuum envelope is formed by oppositely placing a pair of box type glass containers 41 and 42 consisting of soda-lime glass.

First, an intermediate glass plate 12 is installed in the interior of the box type glass container 42 that forms the bottom part of the envelope via a ceramic adhesive material 11 consisting mainly of alumina and inorganic polymers. Next, an anode substrate 14 consisting of alkali-free glass with TFTs 15 and anode-phosphor layers 16 formed thereon is installed on the intermediate glass plate 12 via an adhesive material 13 consisting mainly of zirconia, silica and inorganic polymers. Then, grid electrodes 17 and a filament cathode 18 are arranged above the anode-phosphor layers 16, lead terminals 2 for supplying a external voltage to these electrodes and the TFTs 15 are held down in position between the box-shaped containers 41 and 42, the containers are sealed with first glass that has been applied in advance, and the fabrication is completed by way of the sealing process and the like, thereby obtaining a display panel as shown in FIG. 4.

Generally speaking, the first embodiment has an advantage that the stacking of the intermediate glass plate 12 and the anode substrate 14 though the shaping of the spacers 22 for grids and the lead terminals 2 is more difficult than the second embodiment, whereas the second embodiment is easy in shaping the lead terminals though the stacking of the intermediate glass plate 12 and the anode substrate 14 is more difficult than the first embodiment.

Examples of the coefficient of linear expansion, by material, used for the embodiments are shown in Table 1.

TABLE 1

Coefficient of Linear Expansion by Material

| Name of Material | Coefficient of Linear Expansion | Spot Used |
|---|---|---|
| Quartz Glass | $0.5 \times 10^{-6}$/°C. | Anode Substrate |
| Pyrex Glass | $3.2 \times 10^{-6}$/°C. | Intermediate Glass |
| Soda-lime Glass | $9.5 \times 10^{-6}$/°C. | Envelope Glass |

It is to be noted that the coefficient of linear expansion of the adhesive materials 11 and 13 is preferable to line between the coefficients of linear expansion of the adjacent glass members for the reason as well of relaxation of the thermal stress at the time of curing of the adhesive materials. With the combination of the materials in Table 1 as examples, it is preferable that the coefficient of linear expansion be in the range of 3 to 10 times $10^{-6}$/° C., and the coefficient of linear expansion be in the range of 0.8 to 9 times $10^{-6}$/° C.

Further, the regions of application of the adhesive materials 11 and 13 are preferable to be narrow from the viewpoint of relaxation of thermal stress, and multipoint bonding is preferred to frame-shaped application. When the sizes of the intermediate glass plate and the anode substrate are not sufficiently large, it is desirable to limit the application region of the adhesive materials to only one point at the center of the glass plates. In a prototype made by using the intermediate glass plate and the anode substrate with length of about 60 mm and width of about 30 mm, application of the adhesive materials to only circular areas with diameter of 8 to 10 mm did not give rise to particular difficulties.

It is preferable that thicker materials are used for all members of the device. In particular, for alkali-free glass plate it is preferable to use a material with thickness of 1.1 mm which is the thickest among those commercially available presently. For soda-lime glass to be used for forming vacuum containers a material appropriate for resistance to the pressure is to be adopted. For the prototype with the aforementioned dimensions use of a material with a thickness of 1.8 mm did not lead to any particular problem.

For the intermediate glass plate it is preferable to use a material with thickness substantially equal to or slightly larger than that of alkali-free glass.

As described in the above, in accordance with the present invention it is possible to sharply reduce the occurrence of defects such as breakage, cracks or the like in the substrate by installing an intermediate glass plate between the envelope and the anode substrate consisting of alkali-free glass in order to let the intermediate glass plate absorb the distortion due to thermal stress generated by expansion and contraction during the heating process at the time of fabrication of the VFD panel.

According to the above-mentioned structure, since a thick and inexpensive soda-lime glass can be used for the envelope, a large VFD panel can be obtained without deteriorating TFTs and it can be achieved by loss manufacturing cost compaired with the case of using a specially manufactured alkali-free glass. For the intermediate glass plate use can be made of the ordinary soda-lime glass or pyrex glass, but it is more effective to choose the coefficient of linear expansion of the base glass plate to have a value which is in between the coefficient of linear expansion of the envelope glass and the anode substrate glass. More specifically, the use of the intermediate glass plate having a coefficient of linear expansion which is smaller than 0.8 time the coefficient of linear expansion of the envelope glass and larger than 1.2 times the coefficient of linear expansion of the anode substrate glass, namely, a value of 0.6 to 7.6 times $10^{-6}$/° C., it is possible to reduce the occurrence of defects such as breakage of the substrate and cracks therein, whereby enabling to manufacture large-sized VFD panels.

Needless to say, the present invention is applicable to the configuration in which the lead terminal 2 are led out by means of printed wirings and connected to external terminals outside of the panel although the configuration in which the lead terminals penetrate through the sealing part is described in the above-mentioned embodiments.

What is claimed is:

1. A vacuum fluorescent display panel comprising:

a first glass member;

an intermediate glass plate bonded on said first glass member by using a first adhesive material;

an alkali-free glass plate bonded on said intermediate glass plate by using a second adhesive material, said alkali-free glass plate being provided with thin film transistors and anode-phosphor layers formed thereon;

grid electrodes arranged above said anode phosphor electrodes;

cathodes arranged above said grid electrodes;

a second glass member coupled with said first glass member to form a vacuum envelope; and lead-out electrodes extending from a junction part and connected to electrodes within said vacuum wherein the coefficient of linear expansion of said intermediate glass plate is lower than the coefficient of linear expansion of said first glass member, and is higher than the coefficient of linear expansion of said alkali-free glass plate.

2. A vacuum fluorescent display panel as claimed in claim 1, wherein the coefficient of linear expansion of said intermediate glass plate is less than 0.8 times the coefficient of linear expansion of said first glass member and is more than 1.2 times the coefficient of linear expansion of said alkali-free glass plate.

3. A vacuum fluorescent display panel as claimed in claim 1, wherein the coefficient of linear expansion of said first adhesive material has a value between the coefficient of linear expansion of said first glass member and the coefficient of linear expansion of said intermediate glass plate and the coefficient of linear expansion of said second adhesive material has a value between the coefficient of linear expansion of said intermediate glass plate and the coefficient of linear expansion of said alkali-free glass plate.

* * * * *

UNITED STATES PATENT AND TRADEMARK OFFICE

CERTIFICATE OF CORRECTION

PATENT NO. : 5,150,005

DATED : September 22, 1992

INVENTOR(S) : Shinji Yokono

It is certified that error appears in the above-identified patent and that said Letters Patent is hereby corrected as shown below:

Claim 1, column 4, line 43, after "vacuum" insert --envelope;--.

Signed and Sealed this

Twenty-eighth Day of September, 1993

Bruce Lehman

*Attest:*

BRUCE LEHMAN

*Attesting Officer*

*Commissioner of Patents and Trademarks*